US009882265B2

(12) United States Patent
Cho et al.

(10) Patent No.: US 9,882,265 B2
(45) Date of Patent: Jan. 30, 2018

(54) ANTENNA DEVICE FOR PORTABLE TERMINAL

(75) Inventors: Bum-Jin Cho, Hwaseong-si (KR); Gyu-Sub Kim, Suwon-si (KR); Joon-Ho Byun, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1137 days.

(21) Appl. No.: 13/619,965

(22) Filed: Sep. 14, 2012

(65) Prior Publication Data

US 2013/0321226 A1 Dec. 5, 2013

(30) Foreign Application Priority Data

May 29, 2012 (KR) ..... 10-2012-0056451

(51) Int. Cl.

| | |
|---|---|
| ***H01Q 9/42*** | (2006.01) |
| ***H01Q 1/24*** | (2006.01) |
| ***H01Q 1/48*** | (2006.01) |
| ***H01Q 1/52*** | (2006.01) |
| ***H01Q 13/10*** | (2006.01) |
| *H01Q 5/364* | (2015.01) |
| *H01Q 5/392* | (2015.01) |

(52) U.S. Cl.

CPC ..... *H01Q 1/243* (2013.01); *H01Q 1/48* (2013.01); *H01Q 1/528* (2013.01); *H01Q 9/42* (2013.01); *H01Q 13/10* (2013.01); *H01Q 5/364* (2015.01); *H01Q 5/392* (2015.01)

(58) Field of Classification Search

CPC ..... H01Q 13/10; H01Q 1/243; H01Q 9/42
USPC ..... 343/767–770, 702, 700 MS, 846
See application file for complete search history.

(56) References Cited

U.S. PATENT DOCUMENTS 4,792,809 A * 12/1988 Gilbert ..... H01Q 13/106 343/770
6,768,472 B2 * 7/2004 Alexopoulos ..... H03H 7/40 330/144

(Continued)

FOREIGN PATENT DOCUMENTS

CN 101320843 A 12/2008
CN 102185174 A 9/2011

(Continued)

OTHER PUBLICATIONS

European Search Report dated Aug. 26, 2013 in connection with European Patent Application No. EP 12 18 6065.

(Continued)

*Primary Examiner* — Dameon E Levi
*Assistant Examiner* — Hasan Islam

(57) ABSTRACT

A portable terminal includes an antenna device having a circuit board on a surface of which a conductive layer is formed, a slit that removes a portion of the conductive layer and extends in a direction, an auxiliary board positioned on the slit to face a surface of the circuit board, and a radiation pattern formed on the auxiliary board, in which the radiation pattern is disposed to partially enclose the slit. Even when the radiation pattern is disposed on the conductive layer, induced current generated around the slit can be controlled in the same direction as signal power, thereby preventing radiation performance from being degraded by an inverse current phenomenon in spite of disposition of the radiation pattern on the conductive layer.

10 Claims, 7 Drawing Sheets

(56) References Cited

U.S. PATENT DOCUMENTS

| | | | | |
|---|---|---|---|---|
| 7,079,079 | B2 * | 7/2006 | Jo | H01Q 1/243 343/700 MS |
| 7,764,236 | B2 * | 7/2010 | Hill | H01Q 1/243 343/702 |
| 2002/0145569 | A1 | 10/2002 | Onaka et al. | |
| 2003/0193439 | A1 | 10/2003 | Park | |
| 2003/0201943 | A1 * | 10/2003 | Kadambi | H01Q 1/243 343/702 |
| 2004/0058723 | A1 * | 3/2004 | Mikkola | H01Q 1/243 455/575.7 |
| 2004/0140938 | A1 | 7/2004 | Kadambi et al. | |
| 2004/0155823 | A1 | 8/2004 | Kossiavas et al. | |
| 2007/0236391 | A1 | 10/2007 | Ryou et al. | |
| 2008/0231521 | A1 | 9/2008 | Anguera Pros et al. | |
| 2008/0316118 | A1 * | 12/2008 | Puente Baliarda | H01Q 9/0421 343/702 |
| 2009/0066596 | A1 | 3/2009 | Fujishima et al. | |
| 2009/0153407 | A1 | 6/2009 | Zhang et al. | |
| 2010/0045552 | A1 | 2/2010 | Ueki | |
| 2010/0214181 | A1 | 8/2010 | Ryou et al. | |
| 2010/0238072 | A1 * | 9/2010 | Ayatollahi | H01Q 1/243 343/700 MS |
| 2011/0156975 | A1 * | 6/2011 | Pros | H01Q 1/243 343/767 |

FOREIGN PATENT DOCUMENTS

| | | | |
|---|---|---|---|
| JP | 2002-314330 | A | 10/2002 |
| JP | 2004-336328 | | 11/2004 |
| JP | 2011130280 | | 6/2011 |
| JP | 2012-085262 | A | 4/2012 |
| KR | 20110057658 | A | 6/2011 |
| WO | WO 2006/097496 | A1 | 9/2006 |

OTHER PUBLICATIONS

International Search Report dated Feb. 26, 2013 in connection with International Patent Application No. PCT/KR2012/007281, 4 pages.

Written Opinion of International Searching Authority dated Feb. 26, 2013 in connection with International Patent Application No. PCT/KR2012/007281, 6 pages.

First Office Action dated Oct. 8, 2015 in connection with Chinese Patent Application No. 2012-80073519.1; 15 pages.

Communication purusant to Article 94(3) EPC dated May 11, 2016 in connection with European Patent Appl. No. 120 186 065.4; 8 pages.

Notification of Reason for Rejection dated May 19, 2016 in connection with Japanese Patent Appl. No. 2015-514882; 6 pages.

* cited by examiner

ANTENNA DEVICE FOR PORTABLE TERMINAL

CROSS-REFERENCE TO RELATED APPLICATION(S) AND CLAIM OF PRIORITY

The present application is related to and claims the benefit under 35 U.S.C. §119(a) of a Korean Patent Application filed in the Korean Intellectual Property Office on May 29, 2012 and assigned Serial No. 10-2012-0056451, the entire disclosure of which is hereby incorporated by reference.

TECHNICAL FIELD OF THE INVENTION

The present application generally relates to a portable terminal, and more particularly, to an antenna device for a portable terminal.

BACKGROUND OF THE INVENTION

Generally, a portable terminal refers to an apparatus carried by a user to execute a communication function with another user, such as voice communication, short text message transmission, or the like, a data communication function such as Internet, mobile banking, multimedia file transmission, or the like, and an entertainment function such as games, music, moving image reproduction, or the like. The portable terminal is generally specialized for a corresponding function such as a communication function, a game function, a multimedia function, an electronic note function, or the like, but recently, with the help of development of electric/electronic technologies and communication technologies, users can enjoy various functions merely with a mobile communication terminal.

As the mobile communication terminals have come into wide use, an effort has been continuously exerted to execute functions including control of vehicles, electric home appliances, etc., payment of transportation expenses, and a security function merely with the mobile communication terminal by mounting a wireless Local Area Network (LAN) or Near Field Communication (NFC) function on the mobile communication terminal, as well as a communication function through communication service operators. Therefore, the portable terminal represented by the mobile communication terminal needs to have various antenna devices mounted thereon. That is, a mobile communication service, a wireless LAN, and NFC are made in different frequency bands, such that respective antenna devices are required.

Moreover, as conversion to a fourth-generation (4G) communication scheme represented by wireless broadband (WiBro) or Long Term Evolution (LTE) has been made recently, super-high speed and broadband antenna devices are required. As such, a plurality of antenna devices are installed in a single portable terminal and at the same time, high-performance antenna devices are required. As a super-high speed and broadband antenna device, an Inverted F Antenna (IFA) or a flat-plate IFA is usefully used.

FIG. 1 is a perspective view schematically showing an antenna device 10 of a portable terminal according to an embodiment of the conventional art, in which the antenna device 10 is based on an IFA structure.

The antenna device 10 is structured by forming a radiation pattern 23 in a carrier 21 mounted on a circuit board 11. The radiation pattern 23 is properly designed according to a frequency band and radiation performance required by the portable terminal. On an end of the radiation pattern 23 is provided a shortcircuit pin 27 connected to a ground layer 13 and is also formed a feeding line 25 with a predetermined distance from the shortcircuit pin 27.

In this IFA structure, when the radiation pattern 23 is positioned on the ground layer 13, upon application of a transmission/reception signal to the radiation pattern 23, an induced current is generated on the ground layer 13 in an inverse direction to signal power flowing along the radiation pattern 23. The strength of the inverse current of the ground layer 13 increases as the signal power applied to the radiation pattern 23 is larger and a distance between the ground layer 13 and the radiation pattern 23 is shorter. The inverse current phenomenon degrades antenna performance, specifically, radiation efficiency, and therefore, to suppress the inverse current phenomenon, it is desirable to dispose the ground layer 13 and the radiation pattern 23 as far as possible from each other.

However, when the antenna device 10 is mounted in the portable terminal, increasing the distance between the ground layer 13 and the radiation pattern 23, i.e., a height H of the carrier 21 on the circuit board 11 hinders miniaturization of the portable terminal.

As an alternative for reducing the height of the carrier in the IFA structure, a fill cut region 15 is formed by partially removing the ground layer 13 on the circuit board 11, and the carrier 21 is disposed in the fill cut region 15. Through such a structure, the radiation pattern 23 is disposed in a position out of the ground layer 13 on the circuit board 11. By disposing the radiation pattern 23 in the fill cut region 15, the inverse current phenomenon is prevented, such that the radiation pattern 23 can be disposed closer to the circuit board 11. In other words, by forming the fill cut region 15, the thickness of the antenna device 10 can be reduced. However, it is substantially impossible to mount another part in the fill cut region 15 on the circuit board 11, such that the use efficiency of the circuit board 11 relative to the area of the circuit board 11 is degraded.

Eventually, the IFA structure, in spite of its super-high speed and broadband performance and usefulness in mounting on the portable terminal, is still an obstacle to miniaturization and slimmerization of the portable terminal.

SUMMARY OF THE INVENTION

To address the above-discussed deficiencies of the prior art, it is a primary object to provide an antenna device contributing to miniaturization and slimmerization of a portable terminal.

The present application also provides an antenna device that can efficiently use an internal space of a portable terminal while being miniaturized and slimmerized.

According to an aspect of the present application, there is provided an antenna device for a portable terminal, the antenna device including a circuit board on a surface of which a conductive layer is formed, a slit that removes a portion of the conductive layer and extends in a direction, an auxiliary board positioned on the slit to face a surface of the circuit board, and a radiation pattern formed on the auxiliary board, in which the radiation pattern is disposed to partially enclose the slit.

According to another aspect of the present application, there is provided an antenna device for a portable terminal, the antenna device including a circuit board on a surface of which a conductive layer is formed, a slit that removes a portion of the conductive layer and extends from a side edge of the conductive layer in a direction, an auxiliary board positioned on the slit to face a surface of the circuit board, and a radiation pattern formed on the auxiliary board, in which the radiation pattern includes a first extension portion positioned on the conductive layer in a side of the slit to extend in parallel with the slit, a second extension portion extending from an end of the first extension portion to enclose an end of the side of the slit, and a third extension portion positioned on the conductive layer in the other side of the slit, at least a portion of which extending from an end of the second extension portion in parallel with the slit.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

For a more complete understanding of the present disclosure and its advantages, reference is now made to the following description taken in conjunction with the accompanying drawings, in which like reference numerals represent like parts.

DETAILED DESCRIPTION OF THE INVENTION

Figure 1:
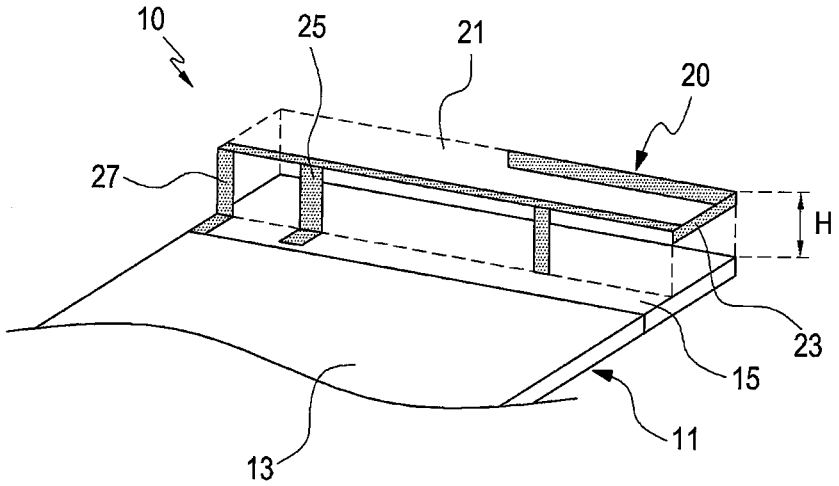
FIG.1 (PRIOR ART)
FIG. 1 is a perspective view schematically showing an antenna device of a portable terminal.

FIGS. 2 through 12, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged wireless communications device. Hereinafter, an exemplary embodiment of the present invention will be described in detail with reference to the accompanying drawings. Herein, a detailed description of well-known structures will not be provided if it unnecessarily obscures the subject matter of the present invention.

As shown in FIGS. 2 through 7, an antenna device 100 for a portable terminal according to an embodiment of the present disclosure includes a circuit board 101 on which a conductive layer 111 is formed and an auxiliary board 121 on which a radiation pattern 123 is formed. The radiation pattern 123 is disposed to partially enclose a slit 113 formed by removing a part of the conductive layer 111.

On the circuit board 101 are mounted a communication circuit for transmitting and receiving a signal through the antenna device 100 and various circuit devices for controlling operations of the portable terminal or storing information. On a surface of the circuit board 101 is provided the conductive layer 111 to provide a ground of circuit devices provided on the circuit board 101. That is, the circuit board 101 is used as the main circuit board 101 of the portable terminal.

As mentioned previously, the slit 113 is formed by removing a part of the conductive layer 111, and extends in a direction on the circuit board 101. Preferably, an end of the slit 113 is opened to the edge of the conductive layer 111 and the other end thereof is positioned in the conductive layer 111 and thus is closed. Moreover, the slit 113 extends in parallel with a corner of the circuit board 101 in a position adjacent to the corner of the circuit board 101.

The auxiliary board 121 is disposed on the slit 113 while facing the circuit board 101. When viewed from the plane view shown in FIG. 3, the slit 113 is covered by the auxiliary board 121. The auxiliary board 121 can be manufactured with a synthetic resin material or a dielectric used to manufacture a typical circuit board.

The radiation pattern 123 can be formed by processing a printed circuit pattern or a metal thin plate and disposing it on a surface of the auxiliary board 121. The printed circuit pattern can be formed directly on the auxiliary board 121 through processing such as plating/etching or the like, or can be used as the radiation pattern 123 by attaching a flexible printed circuit board thereto. The radiation pattern using the metal thin plate is formed by cutting a metal material, e.g., a thin plate of copper, and attaching the cut metal material to the auxiliary board 121. The radiation pattern 123 preferably extends to partially, more specifically, partially enclose each of at least a side, the other end, and the other side of the slit 113.

Figure 3:
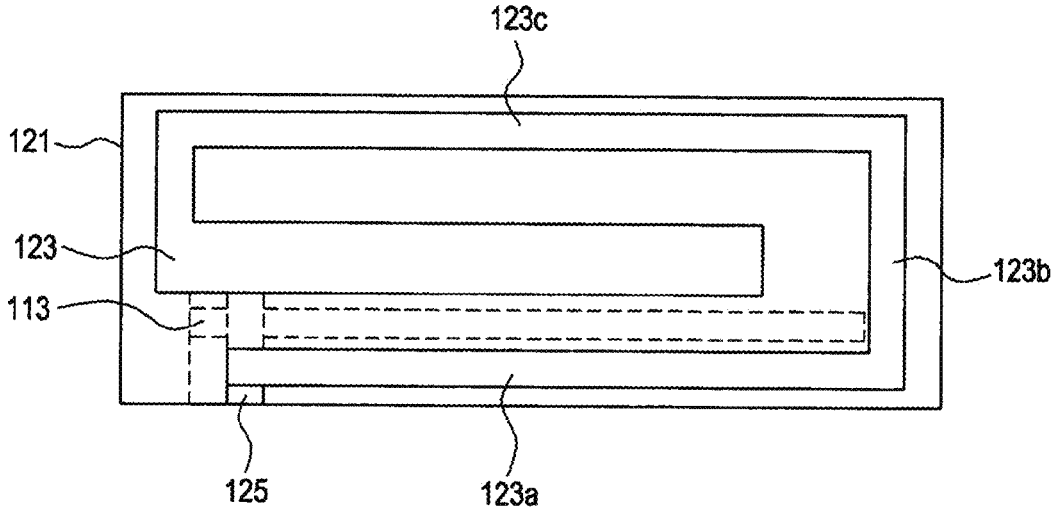
FIG. 3 is a plane view showing an antenna device shown in FIG. 2.

In certain embodiments of the present disclosure, the radiation pattern 123 includes a first extension portion 123*a*, a second extension portion 123*b*, and a third extension portion 123*c*. The first extension portion 123*a* is positioned on the conductive layer 111 in the side of the slit 113 and extends in parallel with the slit 113, and the second extension portion 123*b* extends from an end of the first extension portion 123*a* to enclose the other end of the slit 113, i.e., the closed end of the slit 113. As shown in FIG. 3, the second extension portion 123*b* can overlap at a portion thereof with the other end of the slit 113. The third extension portion 123*c* extends in at least a portion thereof from the end of the second extension portion 123*b* in parallel with the slit 113, and is positioned on the conductive layer 111 in the other side of the slit 113.

That is, the radiation pattern 123 extends from both sides of the slit 113 in parallel, and is interconnected in an outer side of the other end of the slit 113. The third extension portion 123*c* can have a free pattern after extending by a predetermined length from the end of the second extension portion 123*b* in parallel with the slit 113. The partial free pattern of the third extension portion 123*c* can be adjusted to optimize a frequency band in which the antenna device 100 operates, radiation efficiency, and so forth.

In the foregoing description of the radiation pattern 123, 'the radiation pattern 123 is formed or disposed to enclose the slit 113' does not mean that the radiation pattern 123 is actually positioned on the circumference of the slit 113 in the same height as the slit 113. That is, the slit 113 is formed on the conductive layer 111 and the radiation pattern 123 is formed on the auxiliary board 121 disposed to face the conductive layer 111, such that in practice, the radiation pattern 123 and the slit 113 are positioned in different heights with respect to the circuit board 101. However, as shown in FIG. 3, when the antenna device 100 is shown on the plane view, the radiation pattern 123 positioned around the slit 113 is described as 'being formed or disposed to enclose the slit 113'.

In the antenna device 100 structured as described above, induced current is generated on the conductive layer 111 by signal power flowing on the radiation pattern 123, but according to a structure which applies a signal to the radiation pattern 123, current flow on the conductive layer 111 can be induced. That is, the flow of current is generated on the conductive layer 111 in the same direction as that of signal power flowing on the radiation pattern 123, thereby suppressing an inverse current phenomenon. Such suppression can be possible by using some region in the other side of the slit 113, i.e., a region of the conductive layer 111 in which the third extension portion 123*c* is positioned as the radiation pattern 123. In certain embodiments of the present disclosure, for brevity, a pattern formed on the auxiliary board 121 is referred to as the radiation pattern 123, but the antenna device 100 also uses a portion of the conductive layer 111 as a radiation element.

Figure 4:
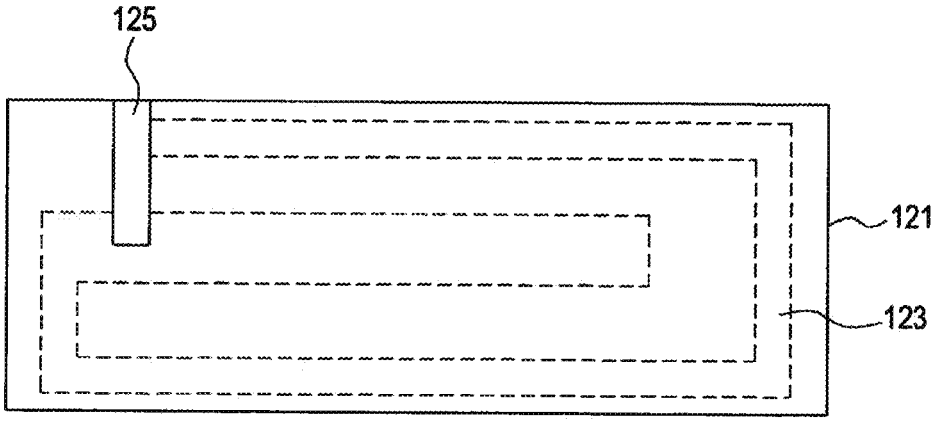
FIG. 4 is a plane view showing a bottom surface of an auxiliary board of an antenna device shown in FIG. 2.
Figure 5:
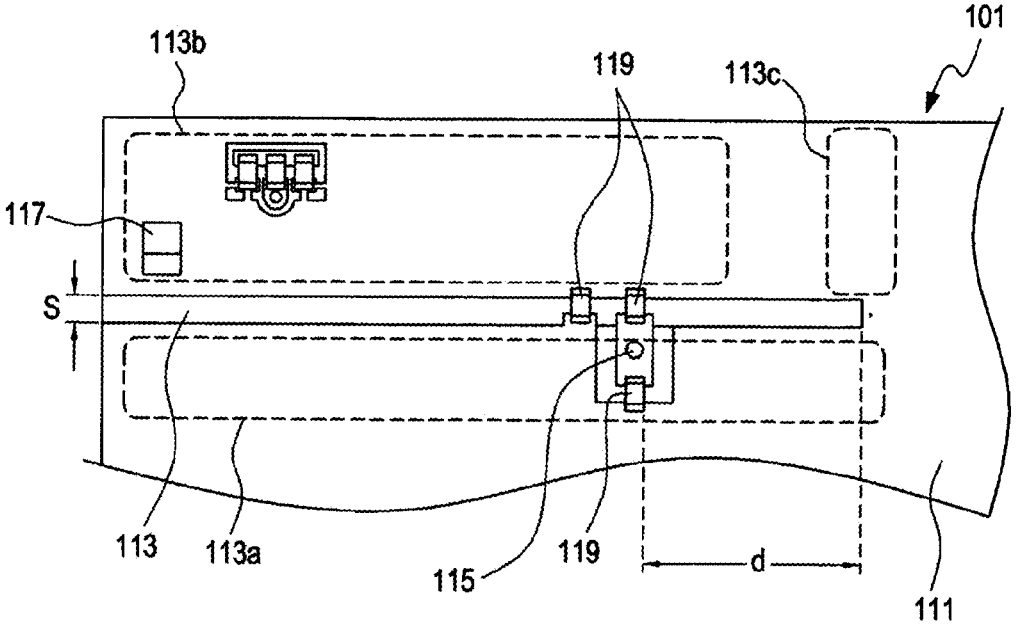
FIG. 5 is a plane view showing a state in which an auxiliary board is removed from an antenna device shown in FIG. 3.
Figure 6:
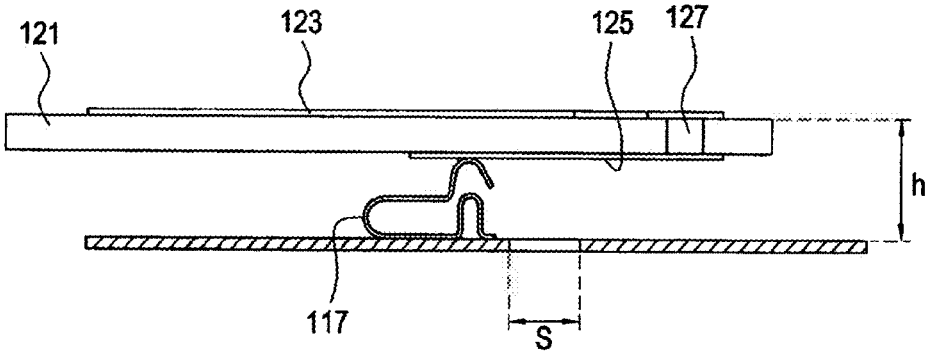
FIG. 6 is a side view showing a modified example of an antenna device shown in FIG. 2.

Referring to FIG. 5, the antenna device 100 includes a feeding line 115 that is connected from a side 113*a* of the slit 113 across the slit 113 to the conductive layer 111 in the other side of the slit 113. The antenna device 100 also includes a connection terminal 117 installed on the conductive layer 111 in a position adjacent to an open end of the slit 113. The connection terminal 117 is formed by processing a leaf spring, and is fixed on the conductive layer 111 while being electrically connected to the conductive layer 111. The connection terminal 117 contacts a connection pattern 125 formed on the other surface of the auxiliary board 121 to be electrically connected with the radiation pattern 123. As shown in FIGS. 3 and 4, the connection pattern 125 extends from the other surface of the auxiliary board 121 to enclose a side of the auxiliary board 121, such that the connection pattern 125 is connected to the radiation pattern 123 on the other surface of the auxiliary board 121. The connection pattern 125 is formed only on the other surface of the auxiliary board 121, and as shown in FIG. 6, the connection pattern 125 can be electrically connected to the radiation pattern 123 through a via hole 127 formed to penetrate the auxiliary board 121.

For impedance matching, the antenna device 100 can include an impedance matching element 119 that can be disposed across the slit 113 or on the feeding line 115. Impedance matching of the antenna device 100 can be achieved by adjusting a distance (d of FIG. 5) from the end of the slit to the feeding line 115.

To the antenna device 100 can be applied a transmission signal through the feeding line 115. The transmission signal applied to the feeding line 115 goes to the radiation pattern 123 through some region of the other side of the slit 113, indicated as '113*b*', and the connection terminal 117. In this case, a region 113*c* that connects the region 113*b* of the conductive layer 111 used as the radiation pattern 123 in the other side of the slit 113 to the conductive layer 111 in the side of the slit 113 is used as a shortcircuit pin. Eventually, the region 113*b* of the conductive layer 111 in the other side of the slit 113 is used together with the radiation pattern 123 as a radiation element of the antenna device 100.

Figure 7:
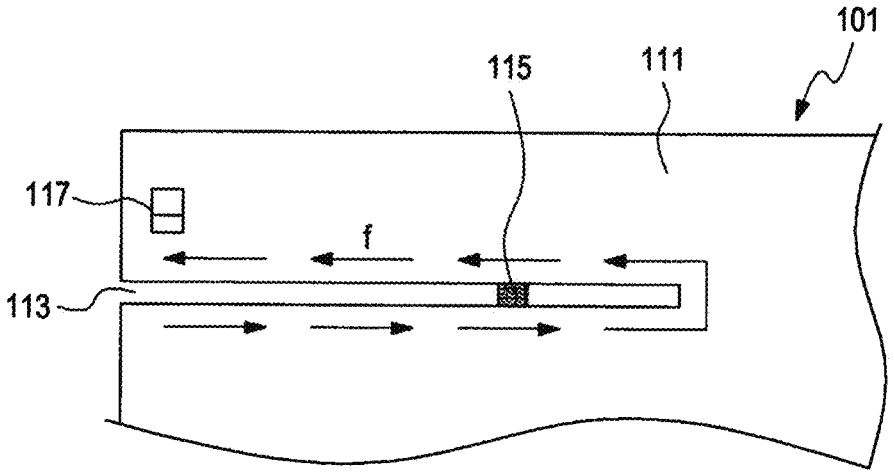
FIG. 7 is a view for describing an induced current flow on a conductive layer in an antenna device shown in FIG. 2.

In this state, upon application of the transmission signal to the feeding line 115, current flow f is formed around the slit 113. The current flow f follows a counterclockwise direction around the slit 113 as shown in FIG. 7. According to the transmission signal applied to the feeding line 115, signal power flowing on the radiation pattern 123 also follows the counterclockwise direction around the slit 113, such that the current flow around the slit 113 and the flow of signal power of the radiation pattern 123 also follow the same direction.

As such, the antenna device 100 according to the present disclosure forms the slit 113 on the conductive layer 111, which provides the ground on the circuit board 101, and uses a region of the conductive layer 111 as a radiation element of the antenna device 100. In signal transmission/reception operations, the flow of current induced on the conductive layer 111 is controlled to prevent an inverse current phenomenon. In certain embodiments of the present disclosure, by using disposition of the feeding line 115 and the connection terminal 117, the flow f of current induced on the conductive layer 111 is controlled to follow the counterclockwise direction around the slit 113. Such control has to be performed in a direction in which the radiation pattern 123 extends on the circumference of the slit 113, more specifically, in the direction of the signal power flowing on the radiation pattern 123.

In this way, the antenna device 100 according to the present disclosure forms the slit 113 on the conductive layer 111 that provides the ground, thereby controlling the flow f of the current flowing around the slit 113, such that the radiation pattern 123 can be disposed in adjacent to the conductive layer 111. Therefore, stable antenna performance can be secured and at the same time, the radiation pattern 123 and the conductive layer 111 can be disposed in adjacent to each other. That is, when compared to in a conventional inverse F antenna, a distance h between the conductive layer 111, which provides the ground, and the radiation pattern 123 can be reduced. In case of a built-in antenna applied to a conventional portable terminal, to secure stable antenna performance, an interval of at least 5 mm needs to be maintained between the ground layer 11 and the radiation pattern 23. Alternatively, the antenna device 100 according to the present disclosure can secure performance equal to or higher than a conventional antenna device even when the radiation pattern 123 is formed within an interval of 2 mm or less from the conductive layer 111.

In addition, conventionally, when a built-in antenna such as an inverse F antenna is disposed, to secure antenna performance, a fill cut region needs to be formed by partially removing the ground layer, but the region 113*b* of the conductive layer 111 used as a radiation element can still provide the ground. That is, in a high-frequency band in which the antenna device 100 operates, the region 113*b* of the conductive layer 111 is used as a part of the radiation element, but the region 113*b* of the conductive layer 111 can still provide the ground for some electric parts or assembly engagement members operating in a low-frequency band. Accordingly, when compared to a conventional built-in antenna, the antenna device 100 according to the present disclosure can easily reduce its thickness and improve the use efficiency of the circuit board 101.

Figure 8:
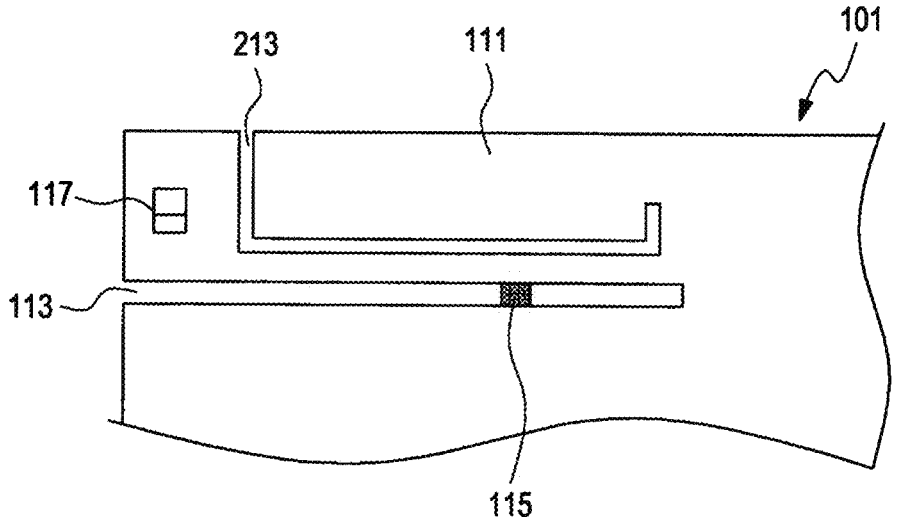
FIG. 8 is a view for describing another modified example of an antenna device shown in FIG. 2.
Figure 9:
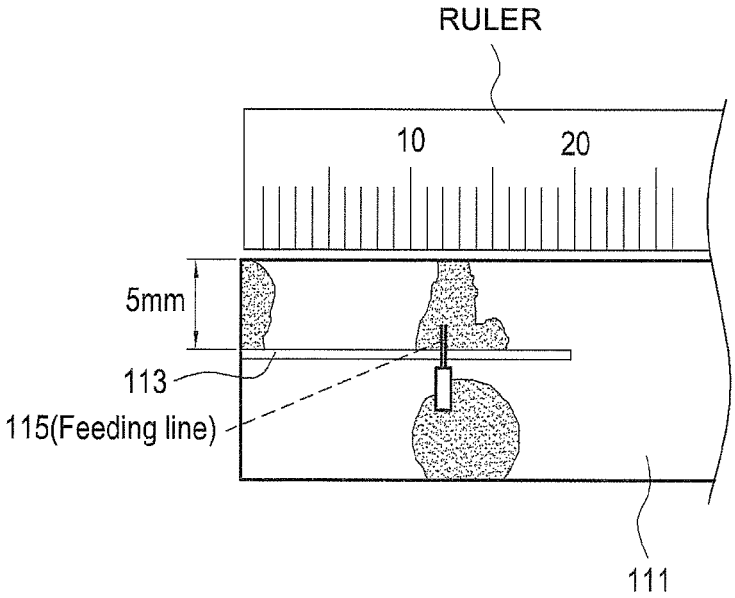
FIGS. 9 and 10 illustrate an implementation of an antenna device shown in FIG. 2.
Figure 10:
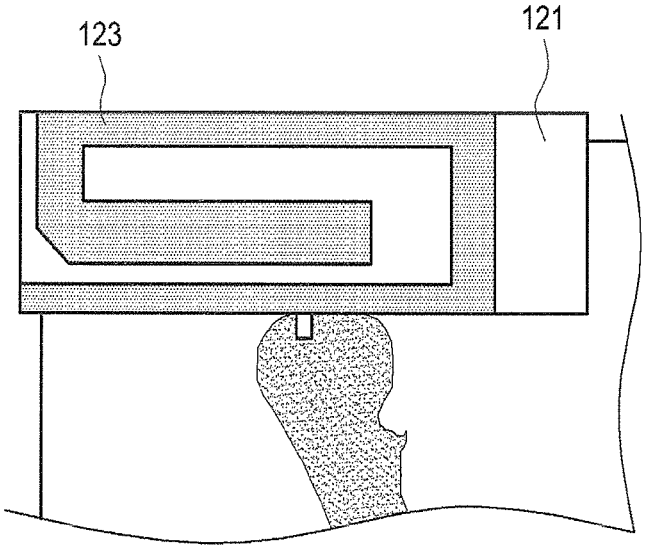

The operating frequency of the antenna device 100 can be adjusted according to a width s of the slit 113 or a width or shape of the radiation pattern 123. Moreover, a lumped circuit element, etc., can be disposed on the radiation pattern 123 or the slit 113 to adjust the operating frequency or the frequency bandwidth. As shown in FIG. 8, another slit 213 can be formed on the region 113*b* of the conductive layer 111 in the other side of the slit 113, or the antenna device 100 can be manufactured as a multi-band antenna according to the shape of the radiation pattern 123.

Figure 2:
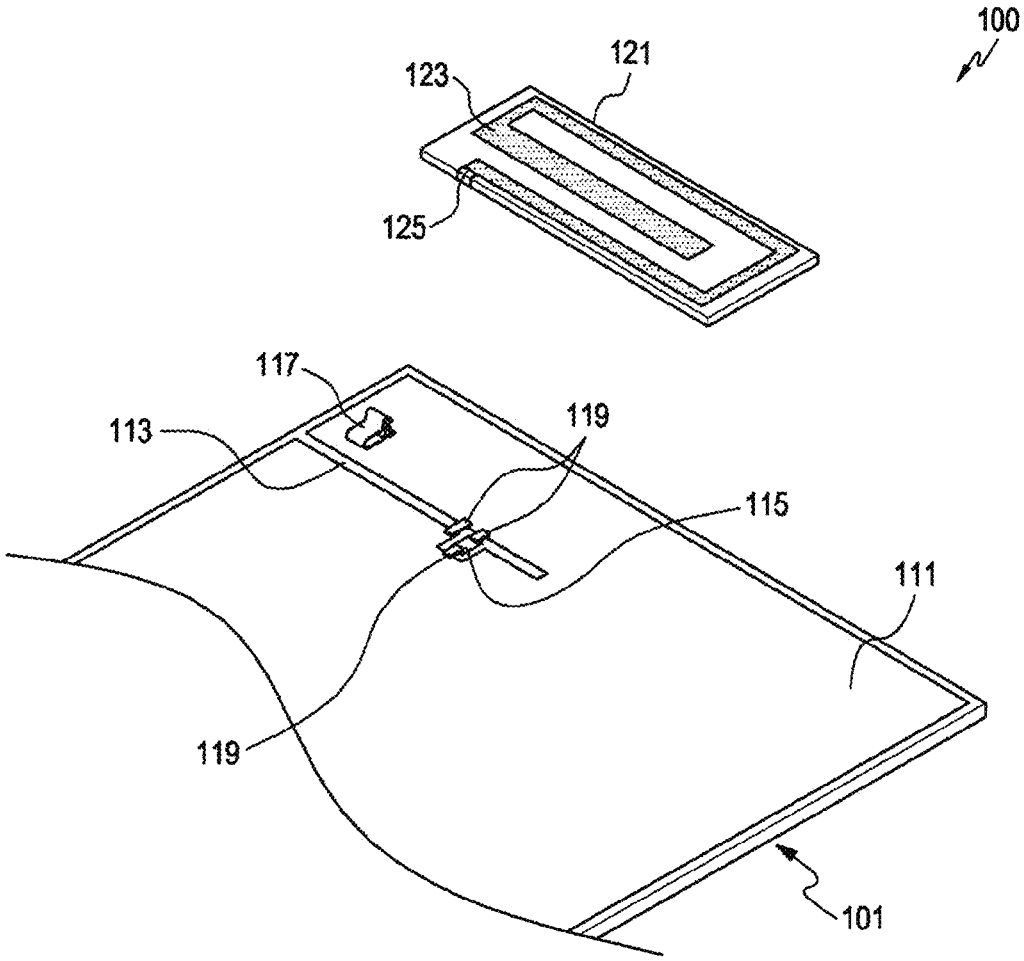
FIG. 2 is perspective view showing an antenna device of a portable terminal according to embodiments of the present disclosure.
Figure 11:
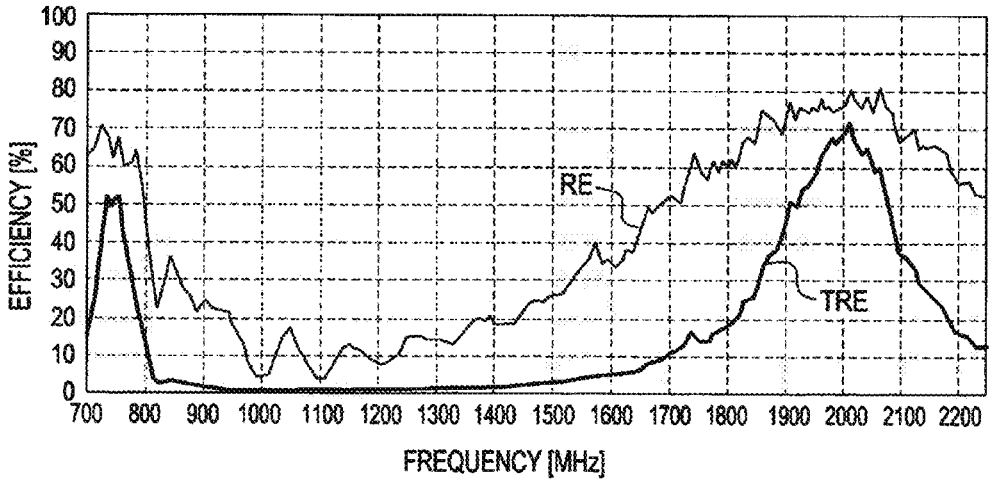
FIG. 11 is a view showing a result of measurement of a radiation efficiency of an antenna device shown in FIG. 10.
Figure 12:
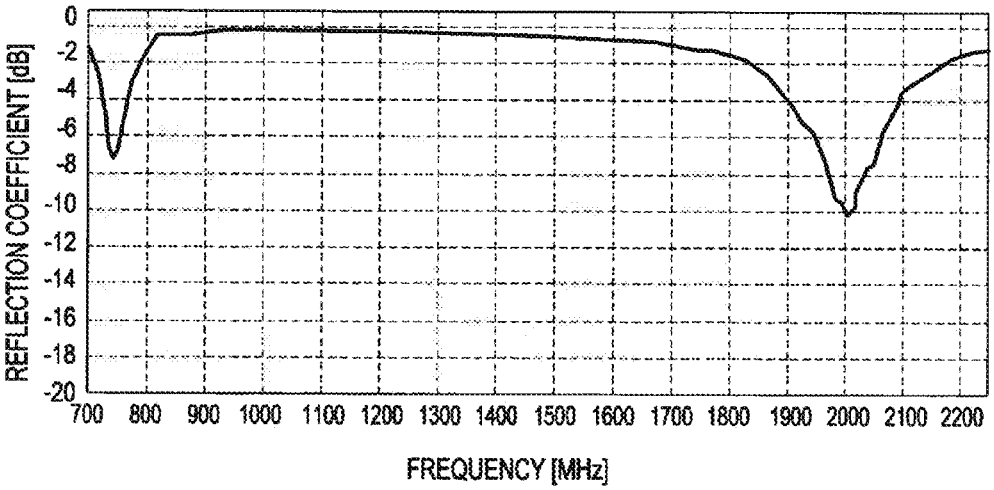
FIG. 12 is a view showing a result of measurement of a reflection coefficient of an antenna device shown in FIG. 10.

According to the structure shown in FIGS. 2 and 3, a slit having a length of 20 mm is formed in parallel with a corner of a circuit board without a distance of 5 mm from the corner of the circuit board, thereby implementing the antenna device 100. Referring to FIG. 6 further, a distance between the conductive layer 111 and the radiation pattern 123 is 1.4 mm, and a thickness of the auxiliary board 121 is 0.4 mm. A state where the antenna device 100 is implemented is shown in pictures of FIGS. 9 and 10. For the above-manufactured antenna device, results of measurement of a radiation efficiency (RE) and a total radiation efficiency (TRE) of the manufactured antenna device are shown in FIG. 11, and a reflection coefficient is shown in FIG. 12. It can be seen from FIGS. 11 and 12 that the antenna device actually implemented according to the present disclosure can secure stable operating characteristics in a band of 700-800 MHz and a band of 1.8-2.2 GHz.

The antenna device for the portable terminal structured as described above can control induced current generated around the slit in the same direction as signal power of the radiation pattern even when the radiation pattern is disposed on the conductive layer. Therefore, even when the radiation pattern is disposed on the conductive layer, it can prevent radiation performance from being degraded by an inverse current phenomenon. Moreover, by preventing the inverse current phenomenon, a total height of the antenna device can be reduced even if the conductive layer is removed from the region of the circuit board in which the radiation pattern is disposed, contributing to reduction of the thickness of the portable terminal. Furthermore, in implementation of the inverse F antenna structure or a flat-plate inverse F antenna structure, the fill cut region does not need to be formed, thereby further securing an area on which a part such as an integrated circuit chip can be mounted on the circuit board.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An antenna device for a portable terminal, the antenna device comprising:

a circuit board comprising a conductive layer on a surface thereof;

a slit formed by a removal of a portion of the conductive layer and configured to extend in a direction, an end of the slit is opened to a side edge of the conductive layer and another end of the slit is closed by another portion of the conductive layer;

a feeding line connected from one side of the slit across the slit to the conductive layer in the other side of the slit and configured to provide a transmission signal from the one side of the slit to the feeding line;

a connection terminal installed on the conductive layer in the other side of the slit;

an auxiliary board positioned on the slit to face the surface of the circuit board;

a connection pattern provided on a surface of the auxiliary board and arranged to contact the connection terminal; and a radiating element formed on the auxiliary board and electrically connected with the connection pattern, the radiating element extends in parallel with the slit in both sides of the slit and is interconnected in an outer side of the closed end of the slit to enclose the slit, wherein a projection of the radiating element on the surface of the circuit board is partially positioned on a circumference of the slit, without covering the slit, when the antenna device is shown on a plane view, and wherein the antenna device generates a current flow on the conductive layer in the same direction as that of a signal power flowing on the radiating element.

2. The antenna device of claim 1, wherein the radiating element is provided on the other surface of the auxiliary board, and the connection pattern extends to enclose a side of the auxiliary board and is connected with the radiating element on the other surface of the auxiliary board.

3. The antenna device of claim 1, further comprising a via hole formed to penetrate the auxiliary board, wherein the connection pattern is electrically connected with the radiating element through the via hole.

4. The antenna device of claim 1, further comprising impedance matching elements provided on the feeding line.

5. The antenna device of claim 1, further comprising a second slit formed by removing a portion of the conductive layer in the other side of the slit.

6. The antenna device of claim 1, wherein the radiating element is a printed circuit pattern disposed on the auxiliary board or a metal thin plate attached to the auxiliary board.

7. An antenna device for a portable terminal, the antenna device comprising:

a circuit board comprising a conductive layer on a surface thereof;

a slit which is formed by removing a portion of the conductive layer and configured to extend from a side edge of the conductive layer in a direction, an end of the slit is opened to a side edge of the conductive layer and another end of the slit is closed by another portion of the conductive layer;

a feeding line connected from one side of the slit across the slit to the conductive layer in the other side of the slit and configured to provide a transmission signal from the one side of the slit to the feeding line;

a connection terminal installed on the conductive layer in the other side of the slit;

an auxiliary board positioned on the slit to face the surface of the circuit board;

a connection pattern provided on a surface of the auxiliary board and arranged to contact the connection terminal; and a radiating element formed on the auxiliary board and electrically connected with the connection pattern, wherein the radiating element comprises:

a first extension portion positioned on the auxiliary board on one side of the slit to extend in parallel with the slit;

a second extension portion extending from an end of the first extension portion to enclose the closed end of the side of the slit;

a third extension portion positioned on the auxiliary board on the other side of the slit, at least a portion of which extending from an end of the second extension portion in parallel with the slit;

a fourth extension portion extending from an end of the third extension portion and parallel to the second extension portion; and a fifth extension portion extending from an end of the fourth extension portion and parallel to the first and third extension portions, such that a projection of the radiating element on the surface of the circuit board is partially positioned on a circumference of the slit, without covering the slit, when the antenna device is shown on a plane view.

8. The antenna device of claim 7, wherein the transmission signal provided from the one side of the slit to the feeding line is delivered to the radiating element through the conductive layer in the other side of the slit and the connection terminal.

9. The antenna device of claim 7, further comprising a via hole formed to penetrate the auxiliary board, wherein the connection pattern is electrically connected with the radiating element through the via hole.

10. The antenna device of claim 8, further comprising impedance matching elements provided on the feeding line.

* * * * *